US005251814A

United States Patent [19]

Warashina et al.

[11] Patent Number: 5,251,814

[45] Date of Patent: Oct. 12, 1993

[54] AIR CONDITIONING APPARATUS HAVING LOUVER FOR CHANGING THE DIRECTION OF AIR INTO ROOM

[75] Inventors: Yoshitaka Warashina; Kazuo Mochizuki, both of Fuji; Noboru Kumagai, Shizuoka; Keiichi Morita, Fujinomiya; Atsushi Nagasawa, Mishima, all of Japan

[73] Assignee: Kabushiki Kaisha Toshiba, Kawasaki, Japan

[21] Appl. No.: 962,118

[22] Filed: Oct. 16, 1992

[30] Foreign Application Priority Data

Oct. 18, 1991 [JP] Japan ..... 3-271317
Oct. 18, 1991 [JP] Japan ..... 3-271318

[51] Int. Cl.[5] ..... F24F 7/00

[52] U.S. Cl. ..... 236/49.3; 62/186; 454/285; 454/258; 454/315

[58] Field of Search ..... 236/49.3, 49.1; 165/16; 62/186; 454/258, 285, 313, 315

[56] References Cited

U.S. PATENT DOCUMENTS 4,671,458 6/1987 Fukuda et al. ..... 236/49.3
4,738,116 4/1988 Himeno et al. ..... 236/49.3

FOREIGN PATENT DOCUMENTS 56-3344 1/1981 Japan .
61-49574 10/1986 Japan .
218757 9/1987 Japan ..... 454/315
237241 10/1987 Japan ..... 454/258
116043 5/1988 Japan ..... 454/315
2210157 6/1989 United Kingdom .

*Primary Examiner*—Harry B. Tanner
*Attorney, Agent, or Firm*—Cushman, Darby & Cushman

[57] ABSTRACT

A louver is provided at an air outlet of an indoor unit. The louver changes the direction of air into the room and swings in a horizontal direction of the room. On the other hand, a temperature sensor unit is provided on the indoor unit. The temperature sensor unit senses temperatures at a plurality of locations in the room. A difference between sensed temperatures of the temperature sensor unit is detected, and the center of swing of the louver is set at a position determined on the basis of the detection result. Further, the angle of swing of the louver is changed in accordance with the detection result.

6 Claims, 16 Drawing Sheets

AIR CONDITIONING APPARATUS HAVING LOUVER FOR CHANGING THE DIRECTION OF AIR INTO ROOM

BACKGROUND OF THE INVENTION

1. Field of the Invention

The present invention relates to an air conditioning apparatus having a louver at an air outlet.

2. Description of the Related Art

There is known an air conditioning apparatus having a louver at an air outlet of an indoor unit, wherein the louver is swung to change the direction of air into the room in a horizontal direction.

For example, in an air conditioning apparatus disclosed in Published Examined Japanese Patent Application (PEJPA) No. 61-49574, the temperatures of air at various locations in the room are sensed by a plurality of temperature sensors. Based on the sensed temperatures, the direction of a louver is changed towards a high-temperature area at the time of cooling, and it is changed towards a low-temperature area at the time of heating. The changed direction is kept for a time period corresponding to a difference between the sensed temperatures.

In an air-conditioning apparatus disclosed in Published Unexamined Japanese Utility Model Application (PUJUMA) No. 56-3344, the temperatures of air at various locations in the room are sensed by a plurality of temperature sensors, and based on the sensed temperatures, the direction of a louver is changed towards a high-temperature area at the time of cooling, and it is changed towards a low-temperature area at the time of heating.

In these apparatuses, when there is a difference between temperatures sensed by the plural sensors provided at various points in the room, the louver is directed so as to reduce the difference. In the case of an air conditioning apparatus which detects temperatures at the right and left locations, the louver is directed to the left when the temperature at the left location becomes lower than that at the right location in the heating mode. Each apparatuses of this type aims at reducing a deviation in a temperature distribution in the room and keeping a uniform temperature in the room.

However, when the temperature difference is small, for example, at the start of driving of the apparatus, the temperature of the left-hand area becomes higher than that of the right-hand area if the louver is directed to the left. Consequently, the direction of the louver is changed to the right, and temperature of the right-hand area becomes higher than that of the left-hand area.

If the direction of air is varied to the right and left in this manner, the temperature distribution in the room is not smoothly made uniform. In addition, a long time is needed to make the temperature distribution in the room uniform.

SUMMARY OF THE INVENTION

The object of the present invention is to make the temperature of the room uniform quickly and surely.

According to this invention, there is provided an air conditioning apparatus having a louver for changing the direction of air into a room, comprising:

- a temperature sensor unit for sensing temperatures at a plurality of locations in the room;

- a controller for detecting a difference between sensed temperatures of the temperature sensor unit;
- a control unit for swinging the louver;
- a control unit for setting the center of swing of the louver at a position corresponding to the detection result of the controller; and
- a control unit for changing the angle of swing of the louver in accordance with the detection result of the controller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A first embodiment of the present invention will now be described with reference to the accompanying drawings.

Figure 1:
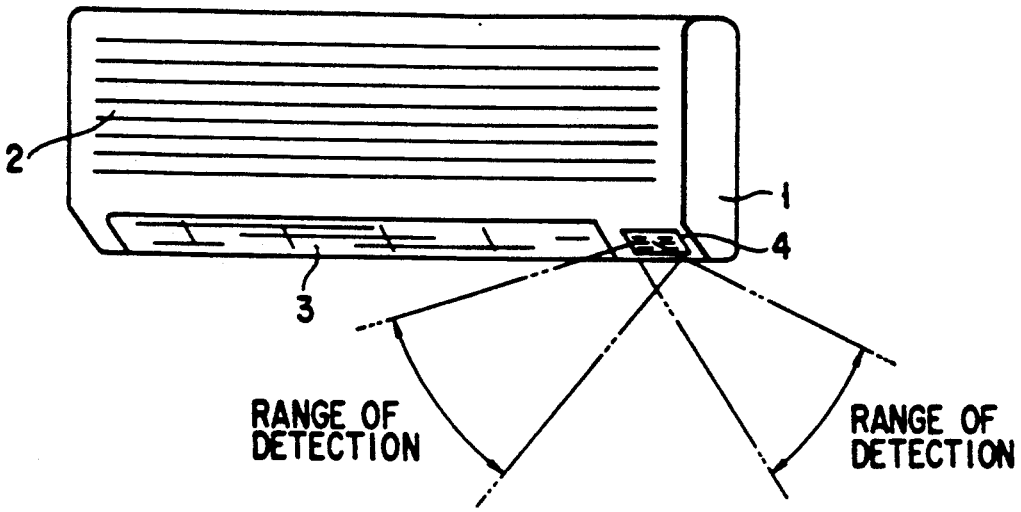
FIG. 1 is a perspective view showing an external appearance of an indoor unit employed in each of embodiments of the present invention.
Figure 2:
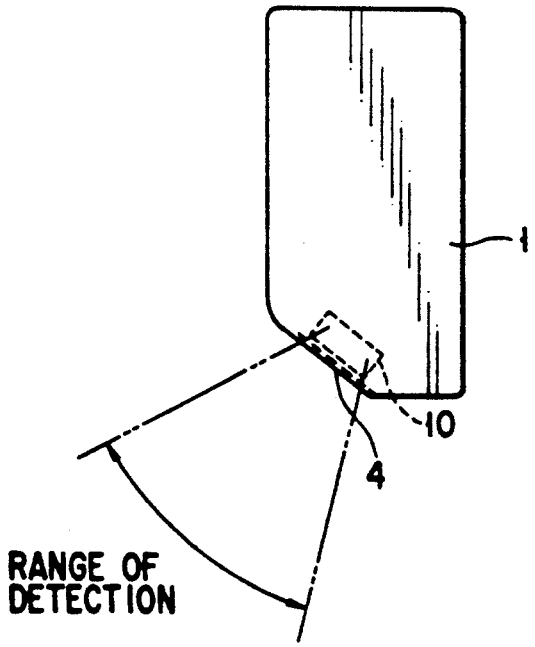
FIG. 2 is a side view of the indoor unit employed in each embodiment.

Referring to FIGS. 1 and 2, reference numeral 1 denotes an indoor unit set on the wall of a room. The indoor unit 1 has an air inlet 2 at its front surface, and an air outlet below the inlet 2. A radiation heat sensing unit 4 is provided adjacent to the air outlet 3.

The radiation heat sensing unit 4 takes in the heat energy radiated from the floor and walls of the room. The sensing unit 4 contains a temperature sensor unit 10.

The temperature sensor unit 10 is designed to sense radiation heat temperatures at two or more locations in the room. The sensor unit 10 has a range of detection for heat energy radiated from the left of the room (L), and a range of detection for heat energy radiated from the right.

Figure 3:
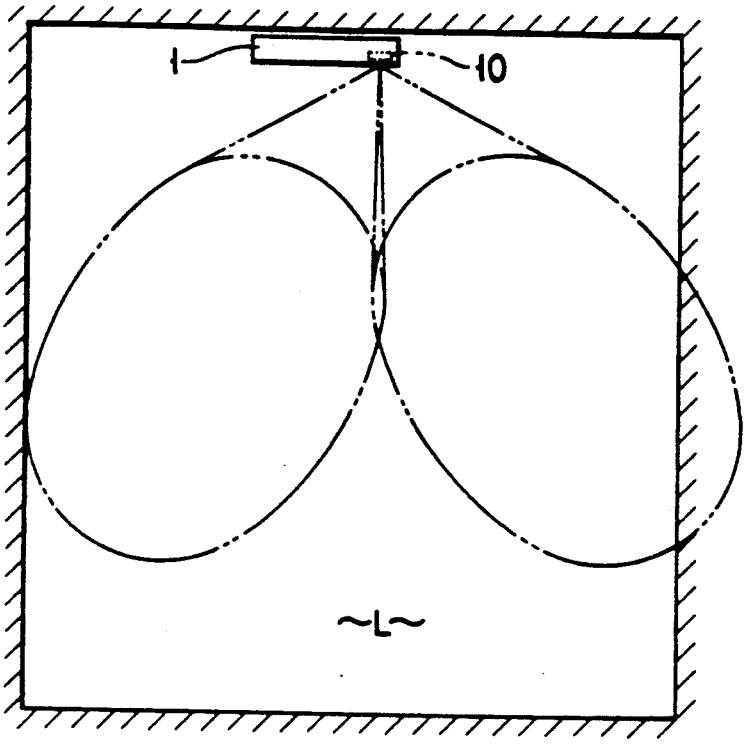
FIG. 3 is a top view showing the ranges of detection of a temperature sensor unit in each embodiment.
Figure 4:
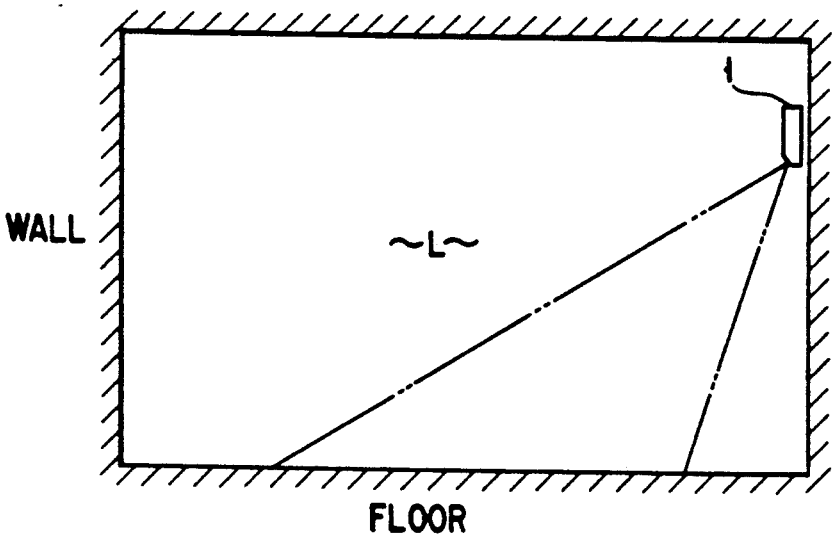
FIG. 4 is a side view showing the ranges of detection of the temperature sensor unit.

In FIGS. 3 and 4, the relationship between the ranges of detection of the temperature sensor unit 10 and the room L is indicated by two-dot-and-dash lines. FIG. 3 is a top view showing the ranges of detection, and FIG. 4 is a side view showing the ranges of detection.

Figure 5:
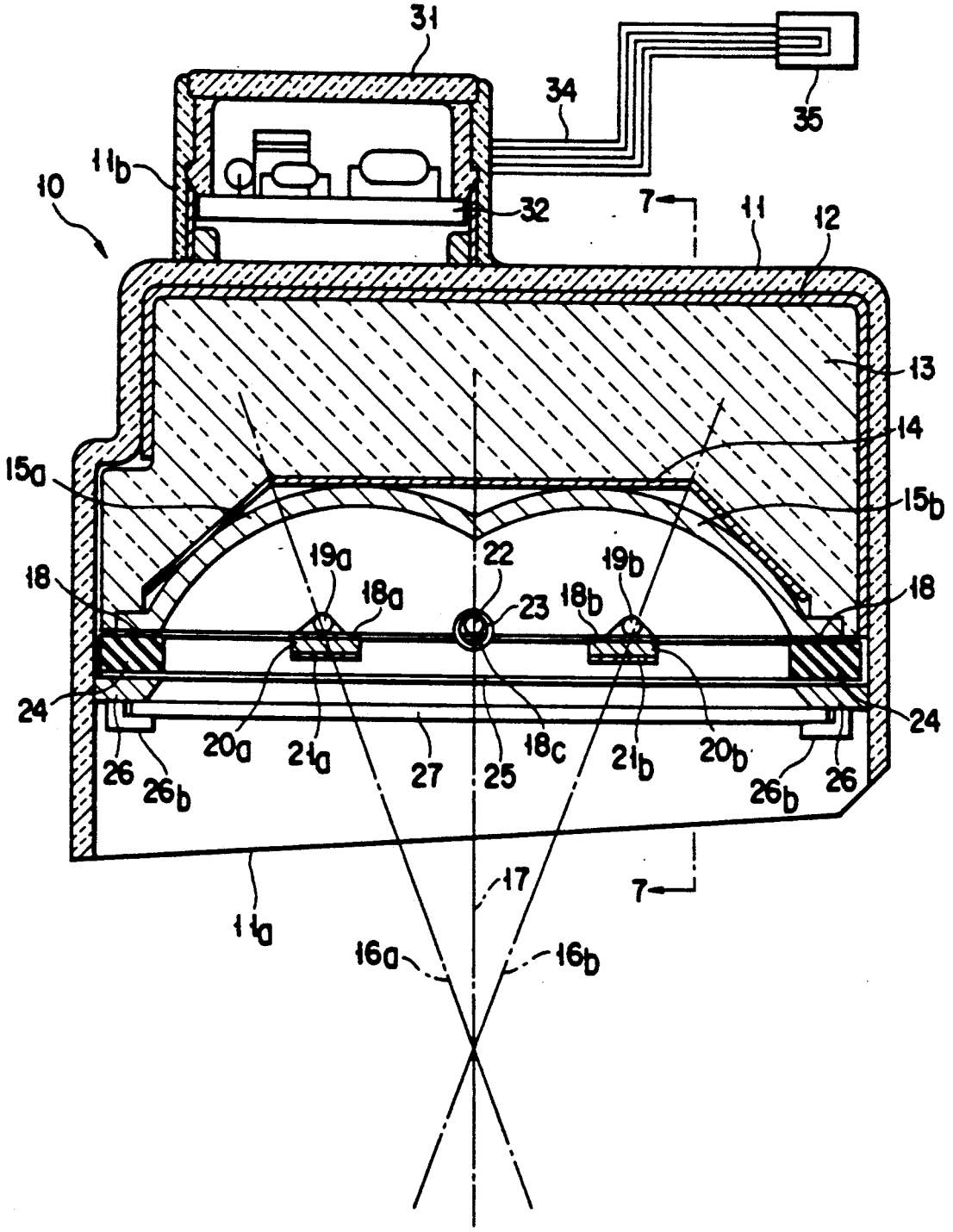
FIG. 5 is a cross-sectional view showing the structure of the temperature unit according to the first embodiment of the invention.
Figure 6:
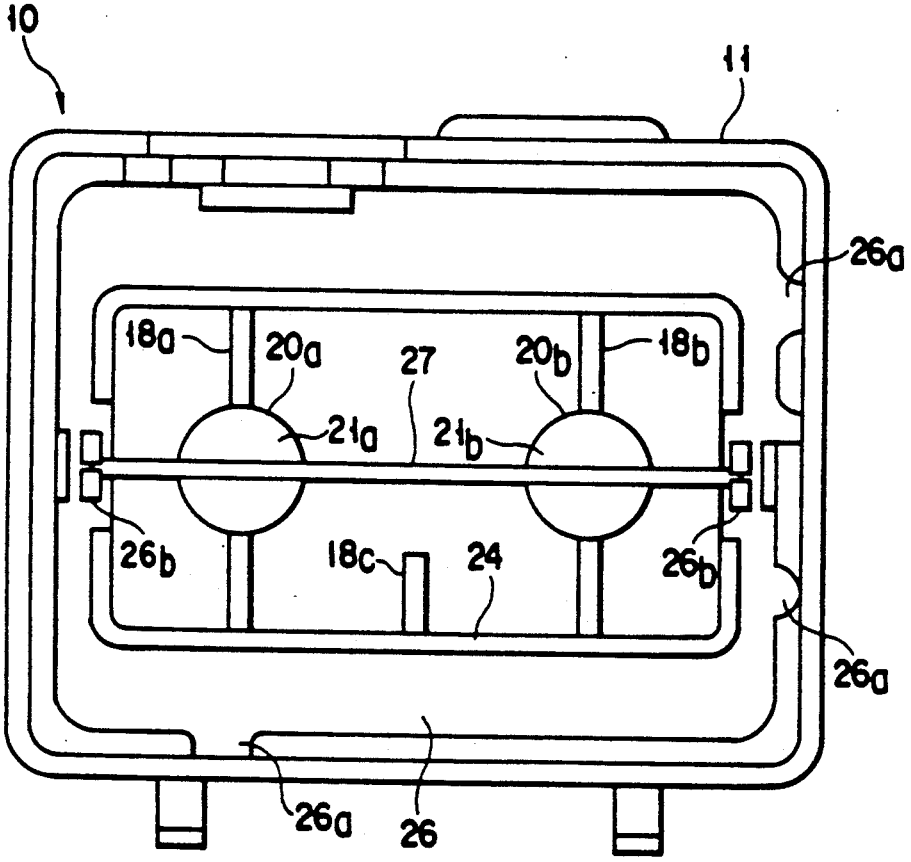
FIG. 6 shows the structure of the temperature sensor unit of the first embodiment, as viewed from the detection face side.
Figure 7:
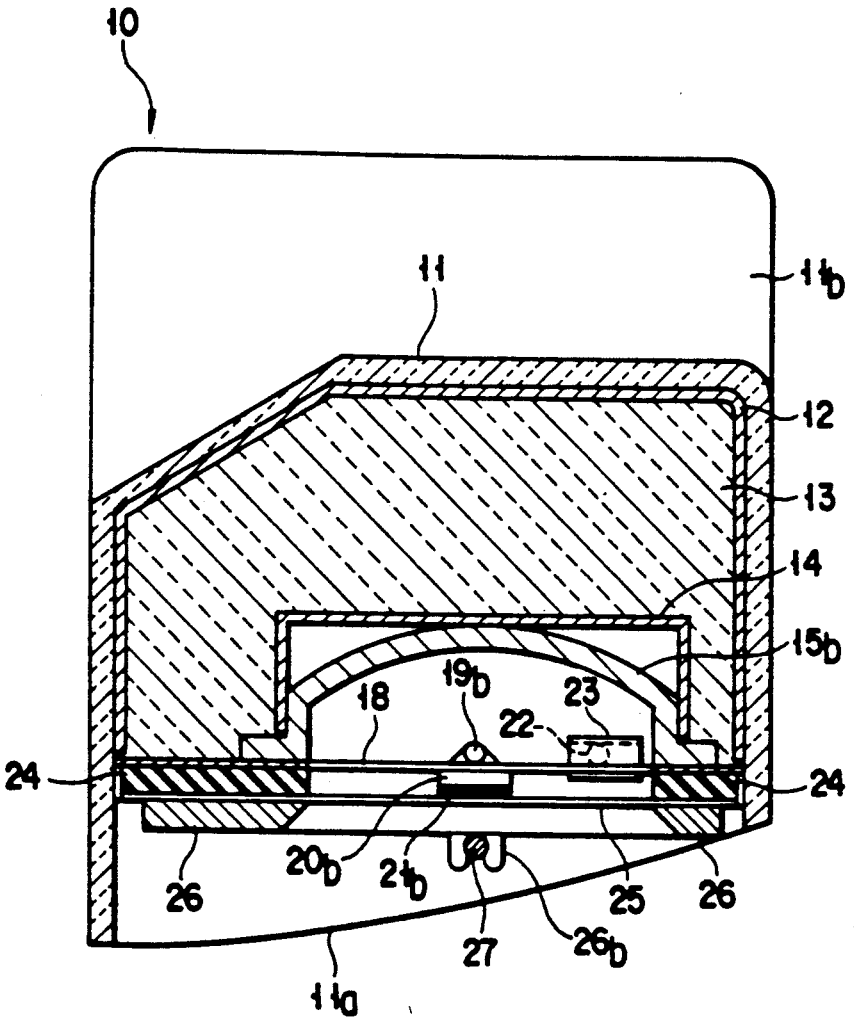
FIG. 7 is a cross-sectional view taken along line 7—7 in FIG. 5.
Figure 8:
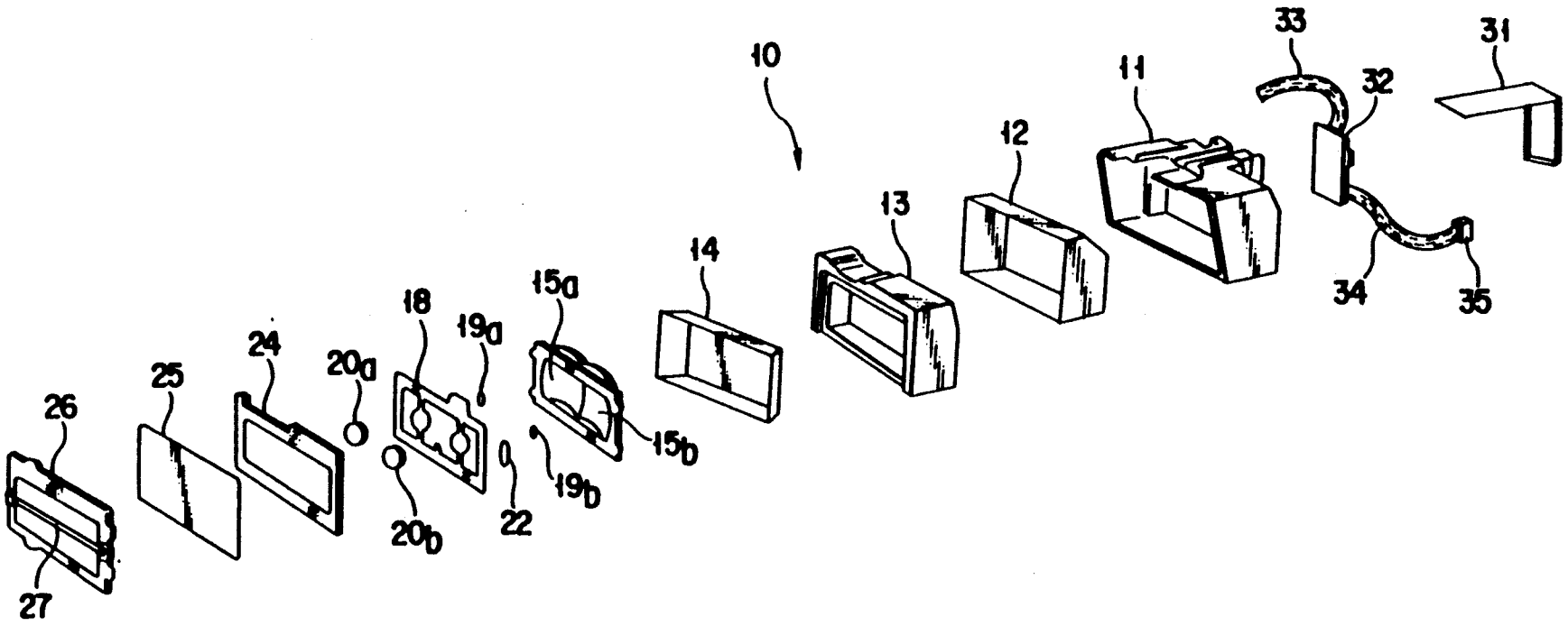
FIG. 8 is a perspective view showing the disassembled parts of the temperature sensor unit of the first embodiment.

Referring to FIGS. 5 to 8, the structure of the temperature sensor unit 10 will now be described. FIG. 5 is a cross-sectional view showing the structure of the temperature sensor unit 10, as viewed from the detection face side, FIG. 7 is a cross-sectional view taken along line 7—7 in FIG. 5, and FIG. 8 is a perspective view showing the disassembled parts of the temperature sensor unit 10.

The external appearance of the temperature sensor unit 10 is defined by a casing 11. The casing 11 is made of a heat-insulating material, and it has a rectangular opening 11*a* for taking in heat energy and a circuit mount unit 11*b* at its rear portion.

A box 12 of aluminum is fitted on the inner surface of the casing 11, and the inside of the box 12 is filled with a heat-insulating material 13 of foamed styrene.

The heat-insulating material 13 has a recess facing the opening 11*a*. A box 14 of aluminum is fitted in the recess. Reflection mirrors 15*a* and 15*b* are laterally arranged within the box 14.

The mirrors 15*a* and 15*b* are parabolic mirrors having the same radius of curvature, and these mirrors are formed by pressing a metallic thin plate or by forming a resin material and subjecting the surface thereof to plating. The axes of the reflection mirrors 15*a* and 15*b* are inclined inwards and intersect each other at a point on a center axis 17 extending forward from the connection point of the mirrors 15*a* and 15*b*. Thus, the reflection mirror 15*a* has directivity to the right of the indoor unit 1, and the reflection mirror 15*b* has directivity to the left of the indoor unit 1. In other words, the reflection mirrors 15*a* and 15*b* are thermally isolated from each other.

A frame-like heat-receiving plate 18 for receiving heat energy is mounted from the opening 11*a* side, thereby holding the reflection mirrors 15*a* and 15*b*. The heat-receiving pate 18 has, on its inner surface, two sensor fixing portions 18*a* and 18*b* with a predetermined distance therebetween. A claw-like sensor fixing portion 18*c* is provided between the sensor fixing portions 18*a* and 18*b*.

Temperature sensors 19*a* and 19*b* for detecting radiation heat are attached to the sensor fixing portions 18*a* and 18*b* by means of a thermally conductive adhesive such as an epoxy adhesive.

The temperature sensors 19*a* and 19*b* are situated on the axes 16*a* and 16*b* and at the focal points of the reflection mirrors 15*a* and 15*b*.

Disc-like heat-insulating members 20*a* and 20*b* are attached to the lower surfaces of the sensor fixing portions 18*a* and 18*b*. The heat-insulating members 20*a* and 20*b* are so-called "heat-insulating members with aluminum foils" having aluminum foils 21*a* and 21*b* on their surfaces looking to the opening 11*a*.

A reference temperature sensor 22 is attached to the upper surface of the sensor fixing portion 18*c* of the heat-receiving plate 18 by an epoxy adhesive, similarly to the above. The reference temperature sensor 22 is situated on the center axis 17. An aluminum foil tape 23 is wound so as to surround the sensor 22 and sensor fixing portion 18*c*.

The temperature sensors 19*a*, 19*b* and 22 are negative characteristic thermistors of the same specifications. These sensors, however, may be positive characteristic thermistors.

An infrared transmissive film 25 functioning as a filter is provided below the lower surface of the heat-receiving plate 18 with a frame-shaped elastic spacer 24 interposed. The film 25 is held by a filter frame 26. The filter frame 26 has a plurality of projections 26*a* which are fitted in a groove (not shown) in the inner peripheral surface of the casing 11. Thus, the filter frame 26 is fixed to the casing 11. The fixation of the frame 26 is made firm due to a repulsive elastic force of the spacer 24.

The infrared transmissive film 25 is a polyethylene sheet with a thickness of about 100 μm. The film 25 allows infrared to enter the casing 11 but prevents air streams emitted from the outlet 3 from adversely affecting the heat-receiving plate 18 and temperature sensors 19*a*, 19*b* and 22 within the casing 11.

The filter frame 26 has claw portions 26*a* and 26*b* on its lower surface. Both end portions of a rod 27 are inserted and engaged in the claw portions 26*a* and 26*b*. The rod 27 protects the infrared transmissive film 25 against external contact, etc.

The operation of the temperature sensor unit 10 having the above structure will now be described.

Radiation heat energy in the ranges of detection shown in FIGS. 3 and 4, which is radiated from the walls and floor of the room L, enters the temperature sensor unit 10. The radiation heat energy is led to the opening 11*a* as infrared and passes through the infrared transmissive film 25. The infrared, which has passed through the film 25, is incident on the reflection mirrors 15*a* and 15*b* and is reflected towards the local points. The infrared is converged at the temperature sensors 19*a* and 19*b* situated at the focal points.

The ambient temperature sensed by the temperature sensors 19*a* and 19*b* is also sensed by the reference temperature sensor 22 of the sensor fixing portion 18*c*.

On the other hand, a casing 31 is detachably attached to the circuit mount unit 11*b* provided on the rear surface of the casing 11. A sensor circuit 32 serving as temperature sensing means is contained within the casing 31.

The sensor circuit 32 is connected to lead wires 33 which are introduced into the casing 11. The lead wires 33 extend to the sensor fixing portions 18*a*, 18*b* and 18*c* and are connected to the temperature sensors 19*a*, 19*b* and 22. The output side of the sensor circuit 32 is connected to a control unit 80 (described later) via the lead wires 34 and a connector 35.

Figure 9:
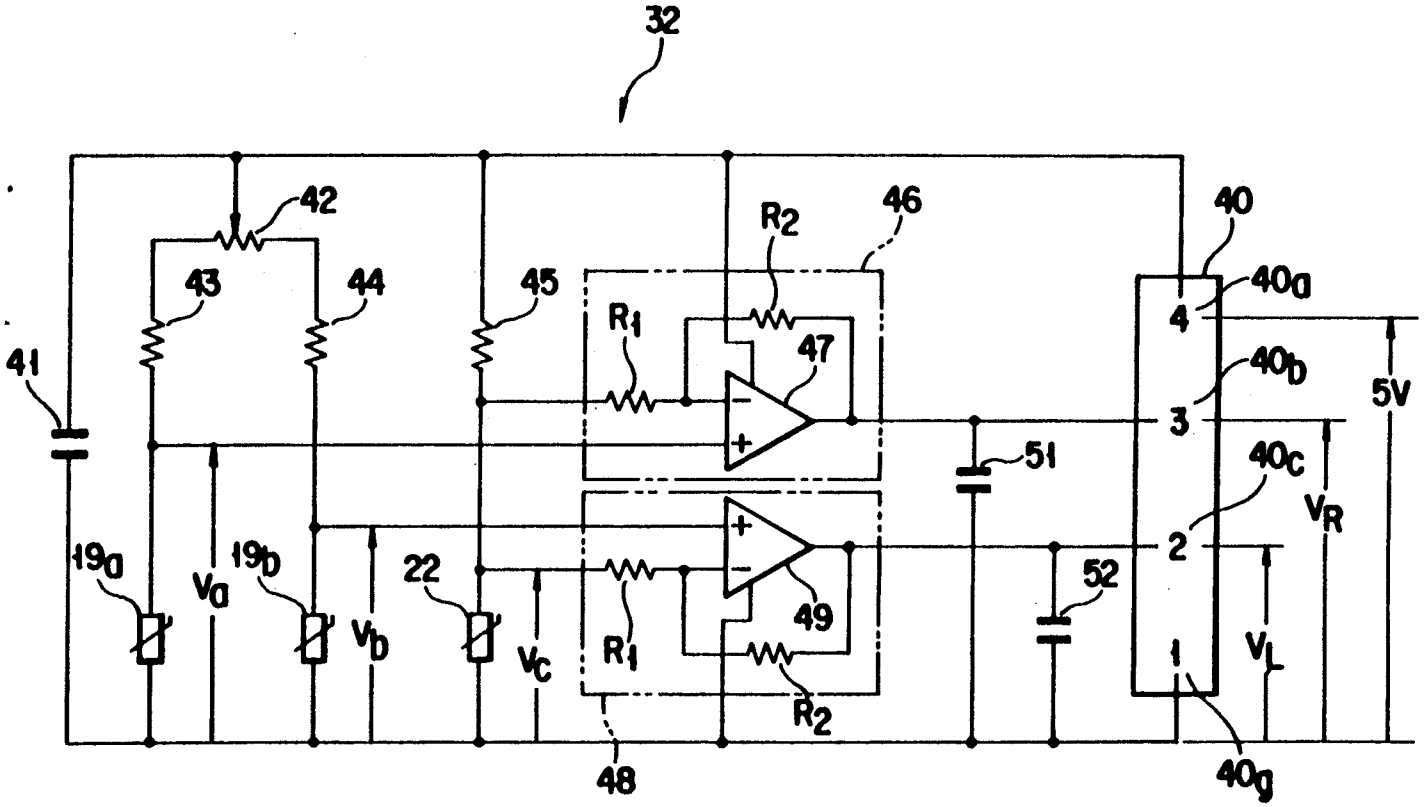
FIG. 9 shows a specific structure of a sensor circuit of the first embodiment.

FIG. 9 shows the specific structure of the sensor circuit 32.

A terminal plate 40 has a power supply terminal 40*a*, an output terminal 40*b*, an output terminal 40*c* and a ground terminal (GND) 40*g*. A driving DC voltage of 5 V is applied across the power supply terminal 40*a* and the ground terminal 40*g*.

A capacitor 41 is connected between the power supply terminal 40*a* and ground terminal 40*g*. A series circuit consisting of a resistor 43 and the radiation heat temperature sensor 19*a* is connected to the capacitor 41 via a semi-fixed resistor 42. A series circuit consisting of a resistor 44 and the radiation heat temperature sensor 19*b* is connected to the capacitor 41 via the semi-fixed resistor 42. Further, a series circuit consisting of a resistor 45 and the reference temperature sensor 22 is connected to the capacitor 41.

A voltage Va produced in the temperature sensor 19*a* and a voltage (reference voltage) Vc produced in the temperature sensor 22 are supplied to a differential amplifier circuit 46. The amplifier circuit 46 comprises an operational amplifier 47, an input resistor $R_1$ and a feedback resistor $R_2$, and it outputs a voltage $V_R$ having a level equal to a difference between the input voltages Va and Vc. The voltage $V_R$ is expressed by $$V_R = Va - (Vc - Va)R_2/R_1$$

The voltage $V_R$ is free from ambient thermal influence and corresponds exactly to the radiation heat temperature of the right-hand range of detection of the indoor unit 1. The voltage $V_R$ is once applied to a capacitor 51 and then output to the outside through the terminals 40*b* and 40*g*.

A voltage Vb produced in the temperature sensor 19*b* and the voltage (reference voltage) Vc produced in the temperature sensor 22 are supplied to a differential amplifier circuit 48. The amplifier circuit 48 comprises an operational amplifier 49, an input resistor $R_1$ and a feedback resistor $R_2$, and it outputs a voltage $V_L$ having a level equal to a difference between the input voltages Vb and Vc. The voltage $V_L$ is expressed by $$V_L = Vb - (Vc - Vb)R_2/R_1$$

The voltage $V_L$ is free from ambient thermal influence and corresponds exactly to the radiation heat temperature of the left-hand range of detection of the indoor unit 1. The voltage $V_L$ is once applied to a capacitor 52 and then output to the outside through the terminals 40*c* and 40*g*.

The semi-fixed resistor 42 is used for zero-point adjustment in order to remove "variation" of the circuit constant. When the resistance value of the resistor 43 is $r_1$, the resistance value of the resistor 44 is $r_2$ ($=r_1$) and the resistance value of the resistor 45 is $r_3$, the resistance value $r_0$ of the semi-fixed resistor 42 is adjusted to satisfy the equation:

$$r_3 = (r_1 + r_2 + r_0)/2$$

According to the temperature sensor unit 10 with the above structure, the boxes 12 and 14 are provided on the inside of the casing 11 and on the rear side of the reflection mirrors 15*a* and 15*b*, thereby preventing undesirable thermal influence in the indoor unit 1 from adversely affecting the temperature sensor unit 10.

The temperature sensors 19*a* and 19*b*, along with the sensor fixing portions 18*a* and 18*b*, are situated in a "floating" state and within the same space closed by the infrared transmissive film 25. Thus, undesirable influence of heat coming through the infrared transmissive film 25 acts on the temperature sensors 19*a* and 19*b* equally.

The infrared transmissive film 25 prevents dust from entering the casing 11.

By the presence of the high-reflectance heat-insulating members 20*a* and 20*b* with aluminum foils, which are provided on the lower surfaces of the sensor fixing portions 18*a* and 18*b*, influence of secondary radiation from the infrared transmissive film 25 upon the temperature sensors 19*a* and 19*b* can be prevented.

Since both the reference temperature sensor 22 and sensor fixing portion 18*c* are surrounded by the aluminum foil tape 23, influence of secondary radiation from the infrared transmissive film 25 upon the reference temperature sensor 22 can be prevented.

By virtue of the above advantages, the radiation heat temperatures can be precisely detected in the horizontal direction.

At the time of manufacture and maintenance, the rod 27 provided in front of the infrared transmissive film 25 prevents tools or the finger from coming in contact with the infrared transmissive film 25. Thus, the film 25 is protected against damage.

Figure 10:
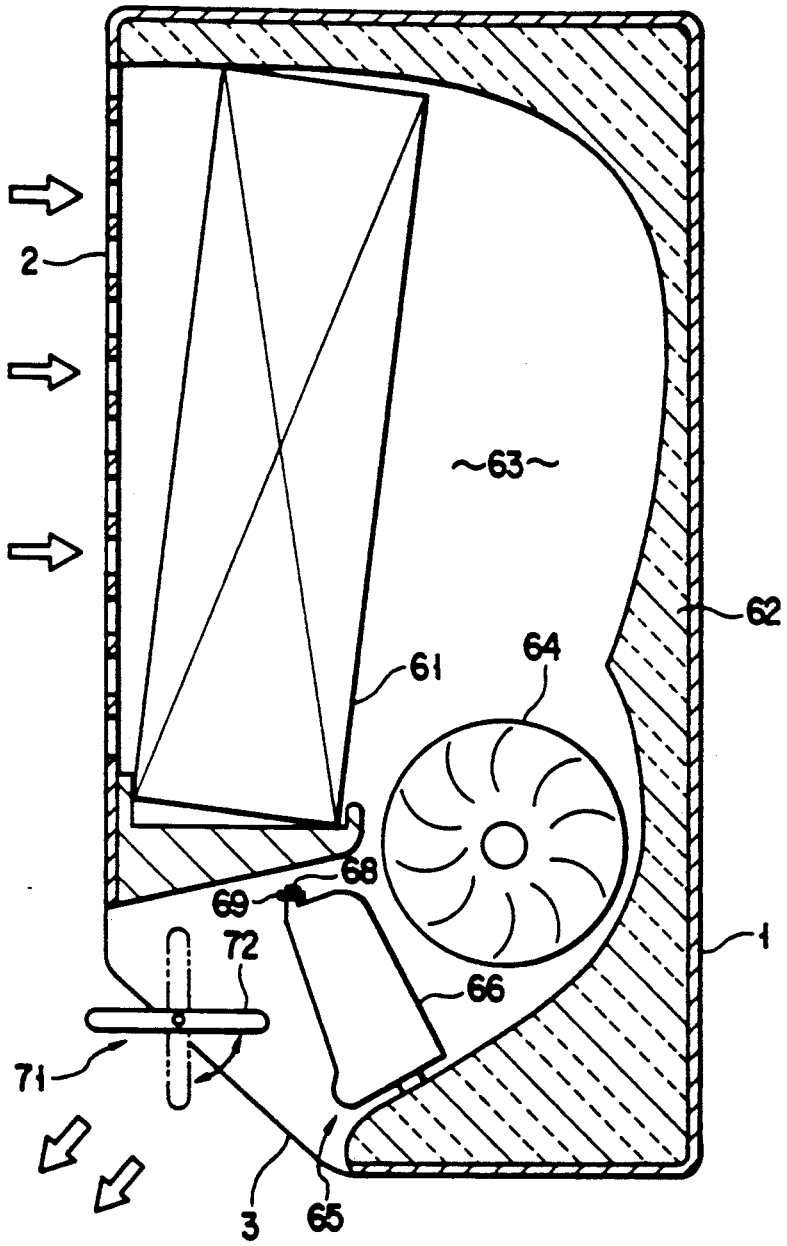
FIG. 10 is a cross-sectional view showing the internal structure of the indoor unit of each embodiment.

FIG. 10 shows the internal structure of the indoor unit 1.

An indoor heat exchanger 61 is provided at a position facing the inlet 2. An air passage is defined by a heat-insulating member 62 from the heat exchanger 61 to the outlet 3. An indoor fan 64, a louver 65 and a louver 71 are arranged in the air passage 63.

Figure 11:
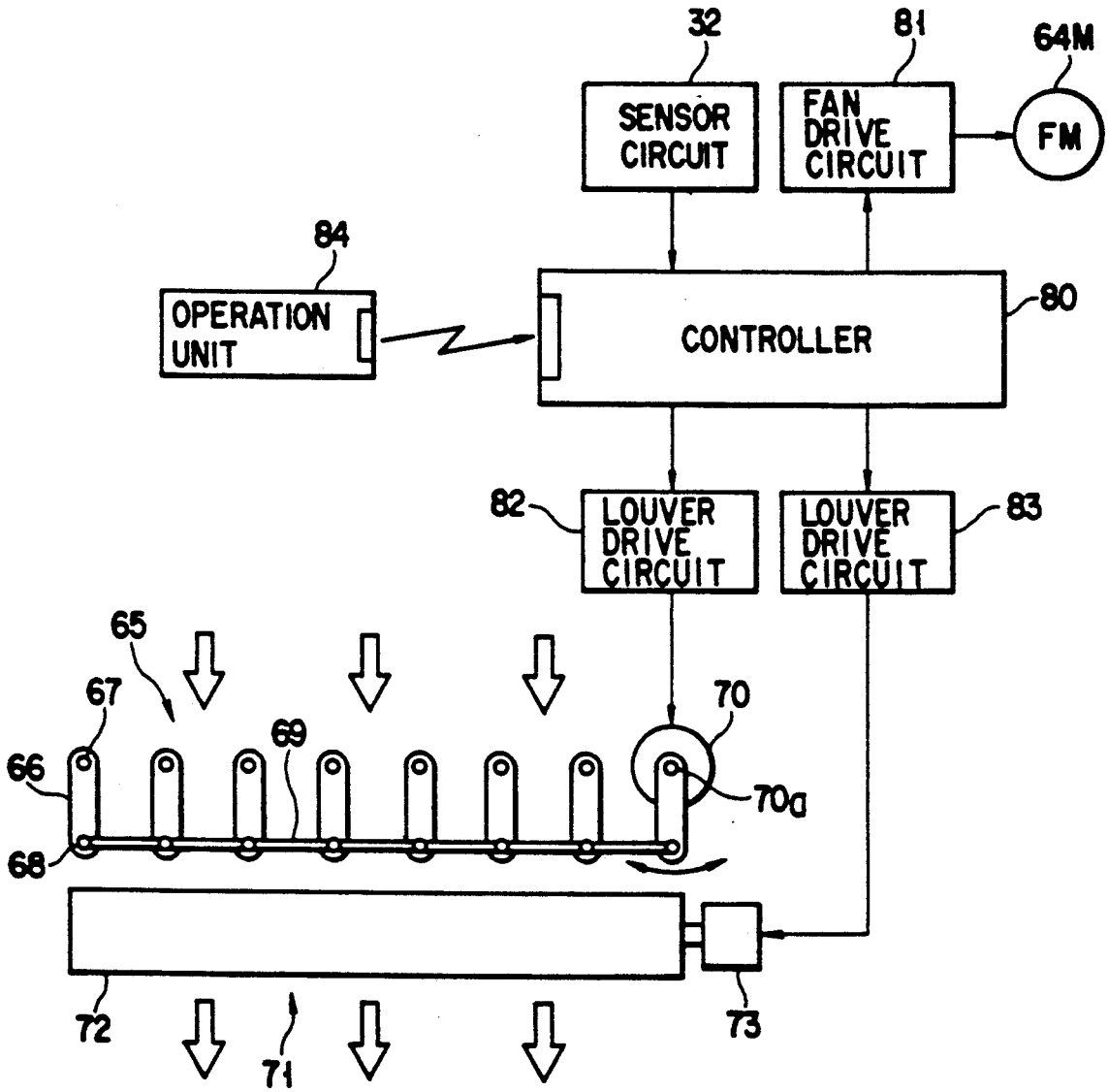
FIG. 11 is a block diagram illustrating the structures of the louvers and control circuit in the first embodiment.

As shown in FIG. 11, the louver 65 comprises blades 66, pins 67 for rotatably holding proximal end portions of the blades 66, pins 68 attached to distal end portions of the blades 66, a rod 69 for loosely coupling the pins 68, and a motor 70 for swinging the blades 66. A rotational shaft 70*a* of the motor 70 is coupled to the proximal end portion of one of the blades 66.

Accordingly, the motor 70 is rotated alternately in the forward and reverse directions, thereby swinging the distal end portions of the blades 66 in the horizontal direction (from the right to the left, and vice versa) of the indoor unit 1. Thus, the direction of air blown into the room is changed in the horizontal direction of the indoor unit 1.

As shown in FIG. 11, the louver 71 has a single blade 72 coupled to a rotational shaft of a motor 73. Accordingly, the motor 73 is rotated alternately in the forward and reverse directions, thereby swinging the blade 72 in the vertical direction of the indoor unit 1. Thus, the direction of air blown into the room is changed in the horizontal direction of the indoor unit 1.

A control circuit shown in FIG. 11 is mounted on the indoor unit 1.

A controller 80 comprises a microcomputer and its peripheral circuits and controls the entire air-conditioning apparatus.

The controller 80 is connected to the sensor circuit 32, a fan drive circuit 81, a louver drive circuit 82 and a louver drive circuit 83.

The fan drive circuit 81 drives an indoor fan motor 64M at a speed determined by a command from the controller 80.

The louver drive circuit 82 drives the motor 70 of the louver 65 in response to a command from the controller 80.

The louver drive circuit 83 drives the motor 73 of the louver 71 in response to a command from the controller 80.

A remote-control type operation unit 84 transmits infrared representing various drive condition data to the controller 80.

The controller 80 comprises the following function means:

[1] means for setting the air-blowing direction of the louver 71 in response to data from the operation unit 84;

[2] means for swinging the louver 65 in the horizontal direction;

[3] means for sensing the temperature $T_{r1}$ of the right-hand area of the indoor unit 1 on the basis of the output voltage $V_R$ of the sensor circuit 32, and sensing the temperature $T_{r2}$ of the left-hand area of the indoor unit 1 on the basis of the output voltage $V_L$ of the sensor circuit 32;

[4] difference detecting means for detecting a difference $\Delta T_r$ $(=T_{r1}-T_{r2})$ between the sensed temperatures;

[5] control means for setting the center of swing of the louver 65 at a reference position corresponding to the detected temperature difference $\Delta T_r$ (the reference position corresponding to the temperature difference $\Delta T_r$ is read out from Table 1 (below) stored in an internal memory of the controller 80); and

[6] control means for varying the angle of swing of the louver 65 in accordance with the detected temperature difference $\Delta T_r$ (the angle corresponding to the temperature difference $\Delta T_r$ is read out from Table 1 (below) stored in an internal memory of the controller 80).

TABLE 1

| | ΔTr | | | | |
|---|---|---|---|---|---|
| | $\Delta Tr \leqq -2$ | $-2 < \Delta Tr < -1$ | $-1 \leqq \Delta Tr < +1$ | $+1 \leqq \Delta Tr < +2$ | $+2 \leqq \Delta Tr$ |
| Center of swing | C | C | B | A | A |
| Angle of swing | 60° | 45° | 30° | 45° | 60° |

Figure 12:
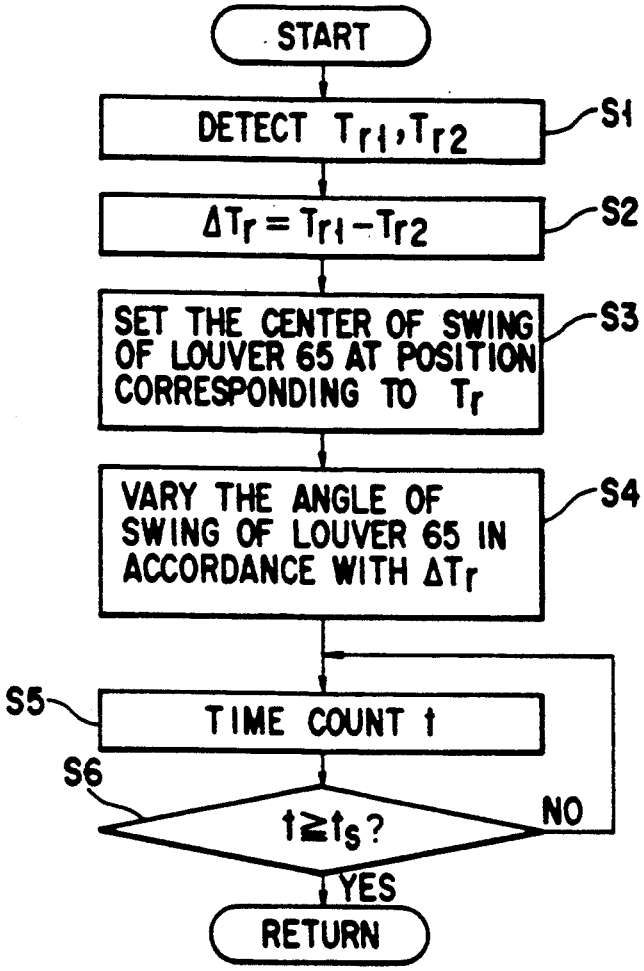
FIG. 12 is a flow chart for illustrating the operation of the first embodiment.
Figure 13:
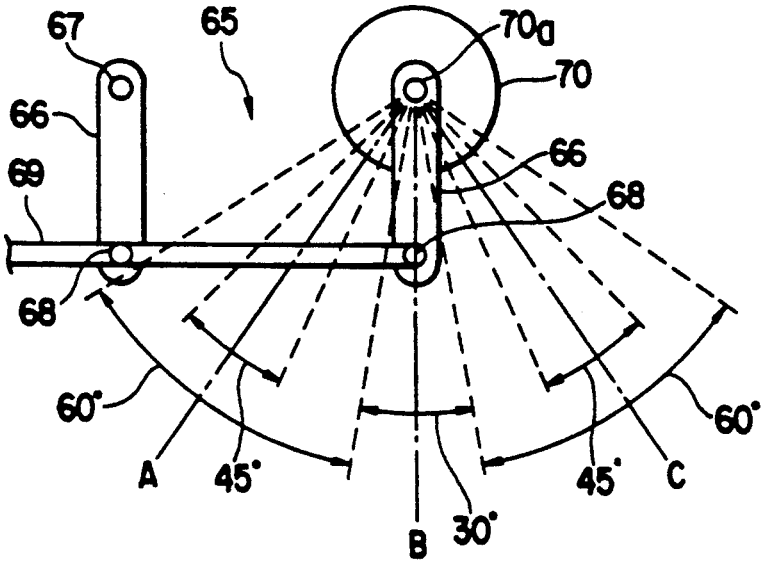
FIG. 13 shows the center of swing of the louver and set angular positions of the louver in the first embodiment.
Figure 14:
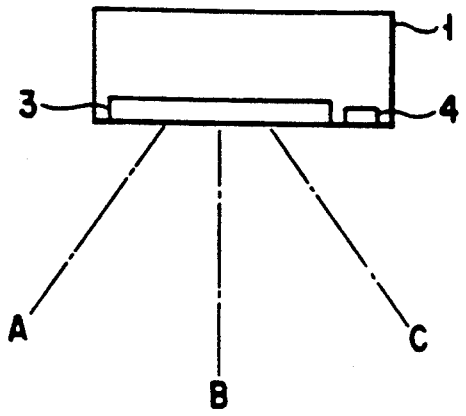
FIG. 14 shows set positions of the center of swing of the louver in the first embodiment.

How the direction of air is changed on the basis of the sensed temperatures of the sensor circuit 32 will now be described with reference to FIGS. 12, 13 and 14.

When the operation of the apparatus is started, the sensor circuit 32 starts to operate and detects the temperature $T_{r1}$ of the right-hand area of the indoor unit 1 and the temperature $T_{r2}$ of the left-hand area (step S1).

The difference $\Delta Tr(=T_{r1}-T_{r2})$ between the temperatures $T_{r1}$ and $T_{r2}$ is detected (step S2). The center of swing of the louver 65 is set at the reference position corresponding to the detected temperature difference $\Delta T_r$ (step S3). Further, the angle of swing of the louver 65 is varied in accordance with the temperature difference $\Delta T_r$ (step S4).

For example, in the heating mode, when the right-hand area temperature $T_{r1}$ is lower than the left-hand area temperature $T_{r2}$ and the temperature difference $\Delta T_r$ is 2° C. or more ($\Delta T_r \leqq -2$), the center of swing of the louver 65 is set to a right-hand reference position C, and the angle of swing of the louver 65 is set at a large angle, i.e. 60°.

Thus, a warm wind is sent to the low-temperature area in a wide range. As a result, the temperature of the wide range of low-temperature area rises and a deviation of the temperature distribution in the room is reduced.

This operational condition continues for a predetermined time period Ts determined by a time count t (steps S5 and S6). After the time period Ts, the difference $\Delta T_r$ between temperatures $T_{r1}$ and $T_{r2}$ is detected and the center and angle of swing of the louver 65 are set once again.

When the temperature difference $\Delta T_r$ decreases to 2° C. or less ($-2<\Delta T_r<-1$) while the temperature $T_{r1}$ of the right-hand area is lower than the temperature $T_{r2}$ of the left-hand area, the angle of swing is reduced to 45° C. while the center of swing of the louver 65 is kept at the right-hand reference position C. In other words, when the low-temperature area is warmed, the angle of swing of air flows is reduced so as not to adversely affect the uniformization of temperature distribution.

When the temperature difference $\Delta T_r$ decreases to 1° C. or less ($-1 \leqq \Delta T_r < +1$) while the temperature $T_{r1}$ of the right-hand area is lower than the temperature $T_{r2}$ of the left-hand area, the center of swing of the louver 65 is set at a neutral reference position B and the angle of swing of the louver 65 is reduced to 30°. In other words, when the temperature difference becomes close to zero, the direction of blown air is set to be perpendicular to the front surface of the indoor unit and the angle of swing of air is reduced so as not to adversely affect the uniformization of temperature distribution.

When the left-hand area temperature $T_{r2}$ is lower than the right-hand area temperature $T_{r1}$, the center of swing of the louver 65 is set at a left-hand reference position A and the angle of swing of the louver 65 is set at 60° or 45° in accordance with the temperature difference $\Delta T_r$.

Unlike the heating mode, in the cooling mode, cool air is sent to the high-temperature area.

As has been described above, the louver 65 is swung horizontally, the radiation heat temperatures of the right-hand area and left-hand area of the indoor unit 1 are sensed, and the center and angle of swing of the louver 75 are set o the basis of the difference between the sensed temperatures, whereby the temperature in the entire room can be made uniform quickly and surely.

In the above embodiment, the center and angle of swing of the louver 65 are set in accordance with the temperature difference $\Delta T_r$. It is possible, however, to store conditions shown in, for example, Table 2 (below) in an internal memory of the controller 80, and set the center of swing of the louver 65 in accordance with the temperature difference $\Delta T_r$ and set the air capacity (i.e. speed of indoor fan motor 64M) of the indoor fan 64 in accordance with the temperature difference $\Delta T_r$.

Specifically, in the heating mode, when the temperature difference $\Delta T_r$ is large, "STRONG" is selected to increase the air capacity, thereby heating the wide range of low-temperature area. When the temperature difference $\Delta T_r$ decreases, "WEAK" or "VERY WEAK" is selected to decrease the air capacity, thereby preventing influence upon the uniformization of temperature distribution.

TABLE 2

| | ΔTr | | | | |
|---|---|---|---|---|---|
| | $\Delta Tr \leqq -2$ | $-2 < \Delta Tr < -1$ | $-1 \leqq \Delta Tr < +1$ | $+1 \leqq \Delta Tr < +2$ | $+2 \leqq \Delta Tr$ |
| Center of swing | C | C | B | A | A |
| Air capacity of indoor | Strong | Weak | Very Weak | Weak | Strong |

Figure 15:
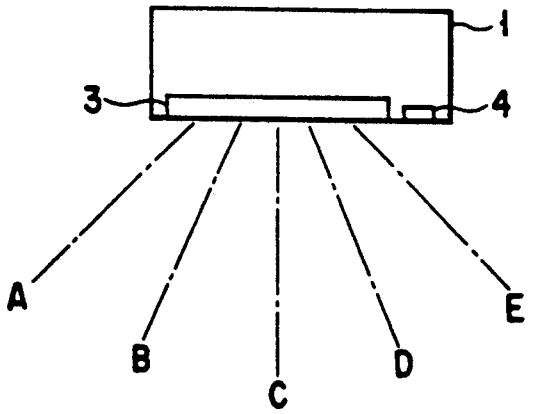
FIG. 15 shows modifications of the set center positions of swing of the louver in the first embodiment.

In the above embodiment, the center of swing of the louver 65 is set at one of the three reference positions A, B and C. However, as shown in FIG. 15, at may be set at one of five reference positions A, B, C, D and E. In this case, for example, when the center of swing is shifted from reference position A to reference position C (i.e. two steps), the center of swing may subsequently be shifted from reference position C to reference position D (i.e. one step), thus achieving a natural change of direction of air.

In the above embodiment, the axes 16a and 16b of the reflection mirrors 15a and 15b are inclined inwards at the same angle, but they may be inclined at different angles. For example, in the case where the indoor unit 1 is attached on the right side of the room, if the angles of inclination of axes 16a and 16b were equal, the temperature of the right-hand area of the room L would mainly be sensed. In such a case, by increasing the angle of inclination of axis 16b of the right-hand reflection mirror 15b and decreasing the angle of inclination of axis 16a of the left-hand reflection mirror 15a, the temperatures of the entire room L can be exactly sensed.

Even if the axes 16a and 16b of reflection mirrors 15a and 15b are inclined outwards, the temperatures of the right and left areas can be detected.

In the above embodiment, the radiation heat sensing unit 4 is provided adjacent to the outlet 3, but the position of the sensing unit 4 is not limited.

A second embodiment of the present invention will now be described.

In the second embodiment, the structures of the temperature sensing unit 10 and control circuit differ from those in the first embodiment. The structures of the indoor unit 1 and louvers 65 and 71 are identical to those in the first embodiment.

Figure 16:
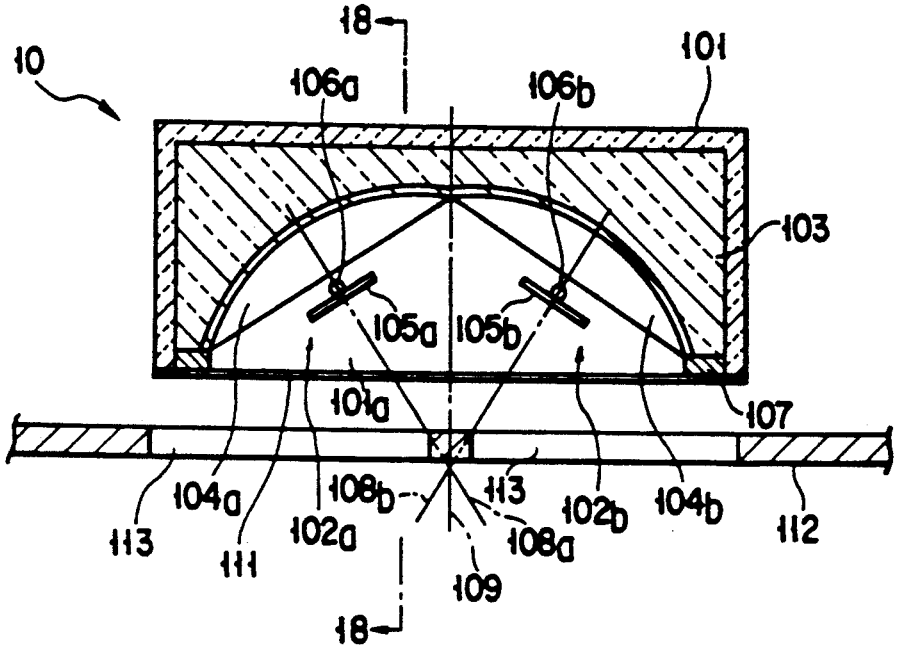
FIG. 16 is a cross-sectional view showing the structure of the temperature sensor unit according to the second embodiment.
Figure 17:
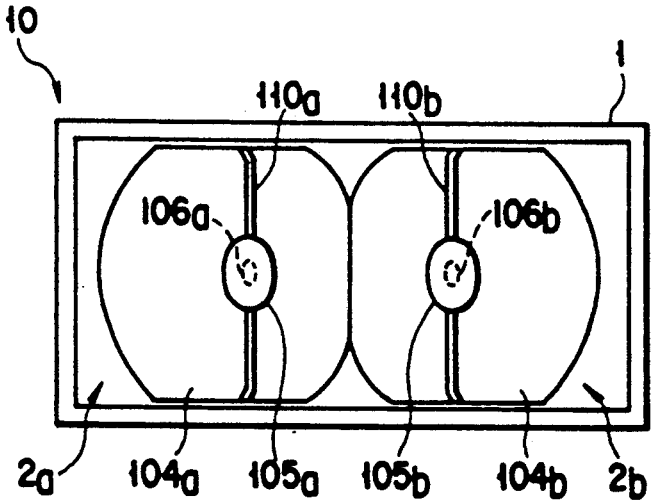
FIG. 17 shows the structure of the temperature sensor unit of the second embodiment, as viewed from the detection face side.
Figure 18:
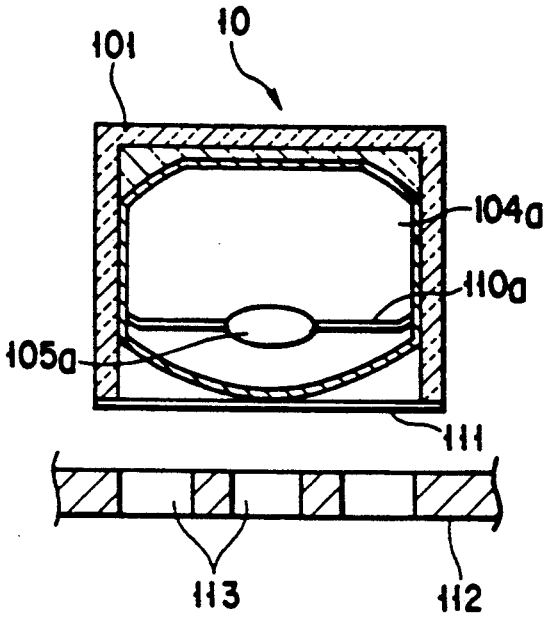
FIG. 18 is a cross-sectional view taken along line 18—18 in FIG. 16.

The structure of the temperature sensor unit 10 will now be described with reference to FIGS. 16, 17 and 18. FIG. 16 is a cross-sectional view showing the internal structure of the temperature sensor unit 10, FIG. 17 shows the structure of the temperature sensor unit 10, as viewed from the detection face side, and FIG. 18 is a cross-sectional view taken along line 18—18 in FIG. 16.

The temperature sensor unit 10 is surrounded by a casing 101. The front surface of the casing 101 is rectangular, and an opening 101a is formed in the front surface of the casing 101. Sensing units 102a and 102b are provided within the opening 101a. A heat-insulating member 103 is filled behind the sensing units 102a and 102b.

The sensing units 102a and 102b comprise, respectively, reflection mirrors 104a and 104b arranged in a horizontal direction of the indoor unit 1, heat-receiving plates 105a and 105b arranged near the focal points of the reflection plates 104a and 104b, and first and second temperature sensors 106a and 106b attached to the rear surfaces (facing the reflections 104a and 104b) of the heat receiving plates 105a and 105b.

A peripheral portion of each reflection mirror 104a, 104b is fixed by a fixing plate 107. The mirrors 104a and 104b are parabolic mirrors having the same radius of curvature, and these mirrors are formed by pressing a metallic thin plate or by forming a resin material and subjecting the surface thereof to plating. The axes 108a and 108b of the reflection mirrors 104a and 104b are inclined inwards and intersect each other at a point on a center axis 109 extending forward from the connection point of the mirrors 104a and 104b. Thus, the reflection mirror 104a has directivity to the right of the indoor unit 1, and the reflection mirror 104b has directivity to the left of the indoor unit 1. In other words, the reflection mirrors 104a and 104b are thermally isolated from each other.

The heat-receiving plates 105a and 105b have disc-like shapes and are formed of, for example, a "glass epoxy" thin plate in order to reduce their own heat capacities. In addition, the heat-receiving plates 105a and 105b are supported at predetermined positions by strip-like bridges 110a and 110b in order to reduce conduction of external heat.

The temperature sensors 106a and 106b are attached to the rear surfaces (facing the reflection mirrors 104a and 104b) of the heat-receiving plates 105a and 105b by means of a heat-conductive adhesive. The temperature sensors 106a and 106b are designed to sense radiation heat temperatures and are connected to a controller 80 (described later) by lead wires (not shown).

The temperature sensors 106a and 106b are attached to the heat-receiving plates 105a and 105b via strip-like bridges 110a and 110b. Thus, the sensors 106a and 106b, along with the heat-receiving plates 105a and 105b, are situated in a "floating " state and are hardly influenced by heat conduction.

The opening 101a of the casing 101 is closed by an infrared transmissive film 111 of a polyethylene sheet having a thickness of about 100 μm. The film 111 allows infrared to enter the casing 101 but prevents air streams emitted from the outlet 3 from adversely affecting the heat-receiving plates 105a and 105b and temperature sensors 106a and 106b within the casing 101.

Figure 19:
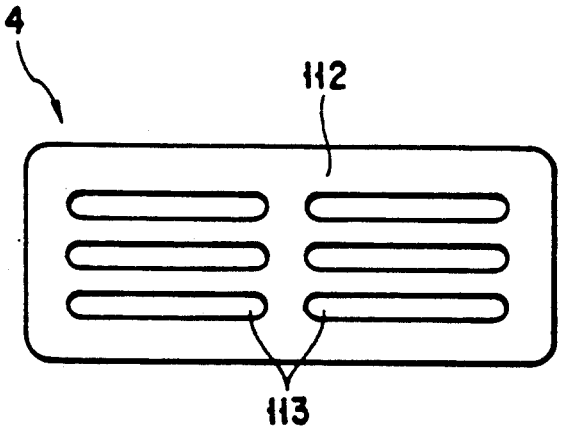
FIG. 19 shows the structure of a panel of a radiation heat detecting unit in the second embodiment.

The radiation heat sensing unit 4 of the indoor unit 1 is covered by a panel 112 shown in FIG. 19. As is shown in FIGS. 16 and 18, the panel 112 faces the infrared transmissive film 111 of the temperature sensor unit 10 at a distance. The panel 112 has slits 113.

The panel 112 is made of a material with a low radiation factor, such as aluminum, stainless steel, or white synthetic resin. The surface of the panel 112 may be subjected to treatment for reducing the radiation factor, for example, it may be plated with aluminum.

The longitudinal direction of the slits 113 of the panel 112 must coincide with the direction in which the sensing units 102*a* and 102*b* are arranged, for a reason stated below. Since the sensing units 102*a* and 102*b* are arranged horizontally, the slits 113 are also formed to extend horizontally.

Figure 20:
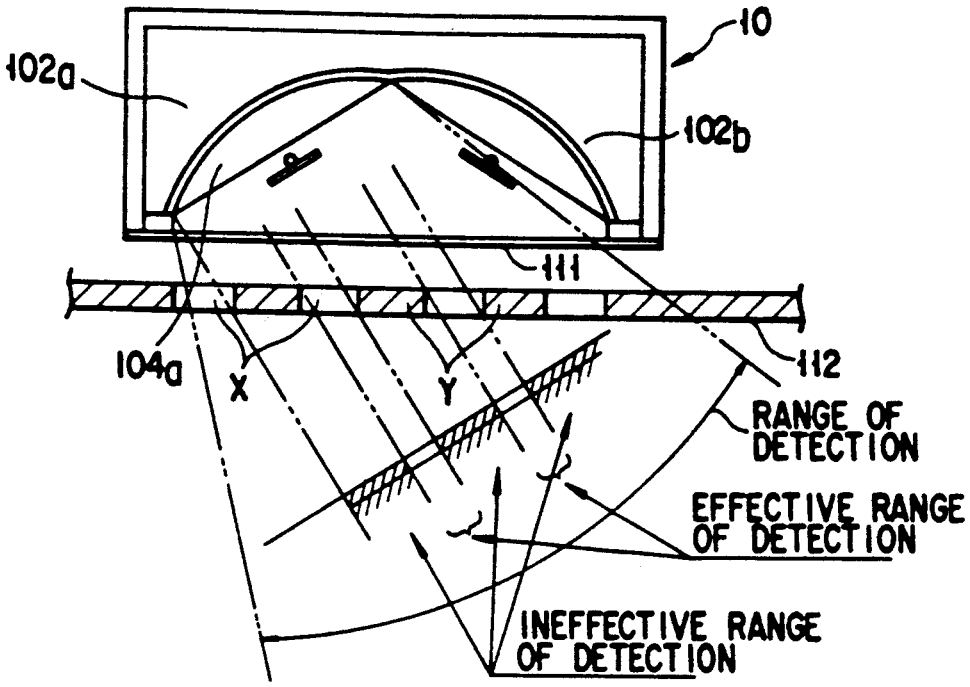
FIG. 20 shows the relationship between the range of detection of the temperature sensor unit and the panel in the second embodiment.

The reason why the longitudinal direction of the slits 113 must coincide with the direction of arrangement of the sensing units 102*a* and 102*b* will now be explained with reference to FIG. 20. FIG. 20 shows only the range of detection of the reflection mirror 104*a*, and does not show the range of detection of the reflection mirror 104*b*.

Suppose that slits X are formed in the panel 112 in a direction perpendicular to the direction in which the sensing units 102*a* and 102*b* are arranged. That portion of the panel 112, at which the slits X are not formed, is denoted by Y.

In this case, that part of the range of detection of the reflection mirror 104*a*, which corresponds to the slits X, is an effective range of detection, and that part of the range of detection, which corresponds to the portion Y, an ineffective range of detection. The presence of the ineffective range of detection adversely affects the sensing of radiation heat temperatures.

It is understood, from this, that the longitudinal direction of the slits 113 of the panel 112 should not be perpendicular to the direction of arrangement of the sensing units 102*a* and 102*b*. In other words, the longitudinal direction of the slits 113 of the panel 112 needs to coincide with the direction of arrangement of the sensing units 102*a* and 102*b*. Thereby, the effective range of defection of each reflection mirror 104*a*, 104*b* can be increased.

The operation of the temperature sensor unit 10 with the above structure will now be described.

The heat energy radiated from the walls and floor of the room L in the ranges of detection shown in FIGS. 3 and 4 enters the radiation heat sensing unit 4. The radiation heat energy passes through the slits 113 of the panel 112 as infrared and reaches the temperature sensor unit 10.

The infrared incident on the temperature sensor unit 10 passes through the infrared transmissive film 111 and enters the opening 101*a*. Then, the infrared is reflected by the reflection mirrors 104*a* and 104*b* and travels to the focal points. The temperature sensors 106*a* and 106*b* are situated at the focal points. The infrared is converged at the temperature sensors 106 and 106*b*.

The radiation exchange heat quantity Q (Kcal/h) of the walls and floor of the room L is expressed by $$Q = E_r \cdot E_w \cdot F \cdot K \cdot A_p \cdot \sigma(T_r^4 - T_w^4) \cdot \eta - Er \cdot Ep \cdot F \cdot (1 - K) \cdot A_p \cdot \sigma(T_p^4 - T_r^4) \cdot \eta$$

wherein $E_r$: the radiation factor of heat-receiving plates 105*a* and 105*b*, $E_w$: the radiation factor of the wall and floor, F: the configuration factor, K: the effective range of detection ratio (effective range of detection/range of detection), $A_p$: the projection area of the reflection mirror 104*a*, 104*b*, $\sigma$: Boltzmann's constant, $T_r$: the sensed temperature (°K.) of temperature sensor 106*a*, 106*b*, $T_w$: the temperature (°K.) of the wall and floor, $T_p$: the temperature (°K.) of panel 112, and $\eta$: the infrared transmission coefficient of infrared transmissive film 111.

The sensing characteristics of the temperature sensor unit 10 is freely controlled by setting the angle of the axes 108*a* and 108*b* of reflection mirrors 104*a* and 104*b*, the radius of curvature of reflection mirror 104*a*, 104*b*, the diameter (area) of heat-receiving plate 105*a*, 105*b*, the distance between the reflection mirrors 104*a*, 104*b* and the heat-receiving plates 105*a*, 105*b*, etc.

In particular, the temperature sensors 106*a* and 106*b*, along with the heat-receiving plates 105*a* and 105*b*, are situated in a "floating" state and within the same air layer defined by the infrared transmissive film 111 within the casing 101. Thus, undesirable influence of external heat acts on the temperature sensors 106*a* and 106*b* equally. Therefore, the temperature difference can be detected with high precision.

Since the opening 101*a* of the casing 101 is closed by the infrared transmissive film 111, dust or the like in the room L does not enter the casing 101. Accordingly, the reflectance of the reflection mirror 104*a*, 104*b* cannot be lowered.

Since the panel 112 is provided in front of the infrared transmissive film 111, it is possible to prevent a rod or the finger from damaging the infrared transmissive film 111.

Since the longitudinal direction of the slits 113 of the panel 112 agrees with the direction of arrangement of the sensing units 102*a* and 102*b*, the effective range of detection of the range of detection of the reflection mirror 104*a*, 104*b* can be increased.

Since the panel 112 is made of a material with low radiation factor, such as aluminum, secondary radiation from the panel 112 can be reduced to a minimum.

Regarding the above equation for finding the radiation exchange heat quantity Q, the negative heat quantity indicated by (−) sign, i.e. $E_r E_p F \cdot (1-K) \cdot A_p \cdot \sigma(T_p^4 - T_r^4) \cdot \eta$ is the secondary radiation heat quantity of the panel 112. Since the secondary radiation heat quantity is reduced to a minimum by the material of the panel 112, the radiation exchange heat quantity necessary for detection of the radiation heat temperature can be introduced into the temperature sensor unit 10.

Figure 21:
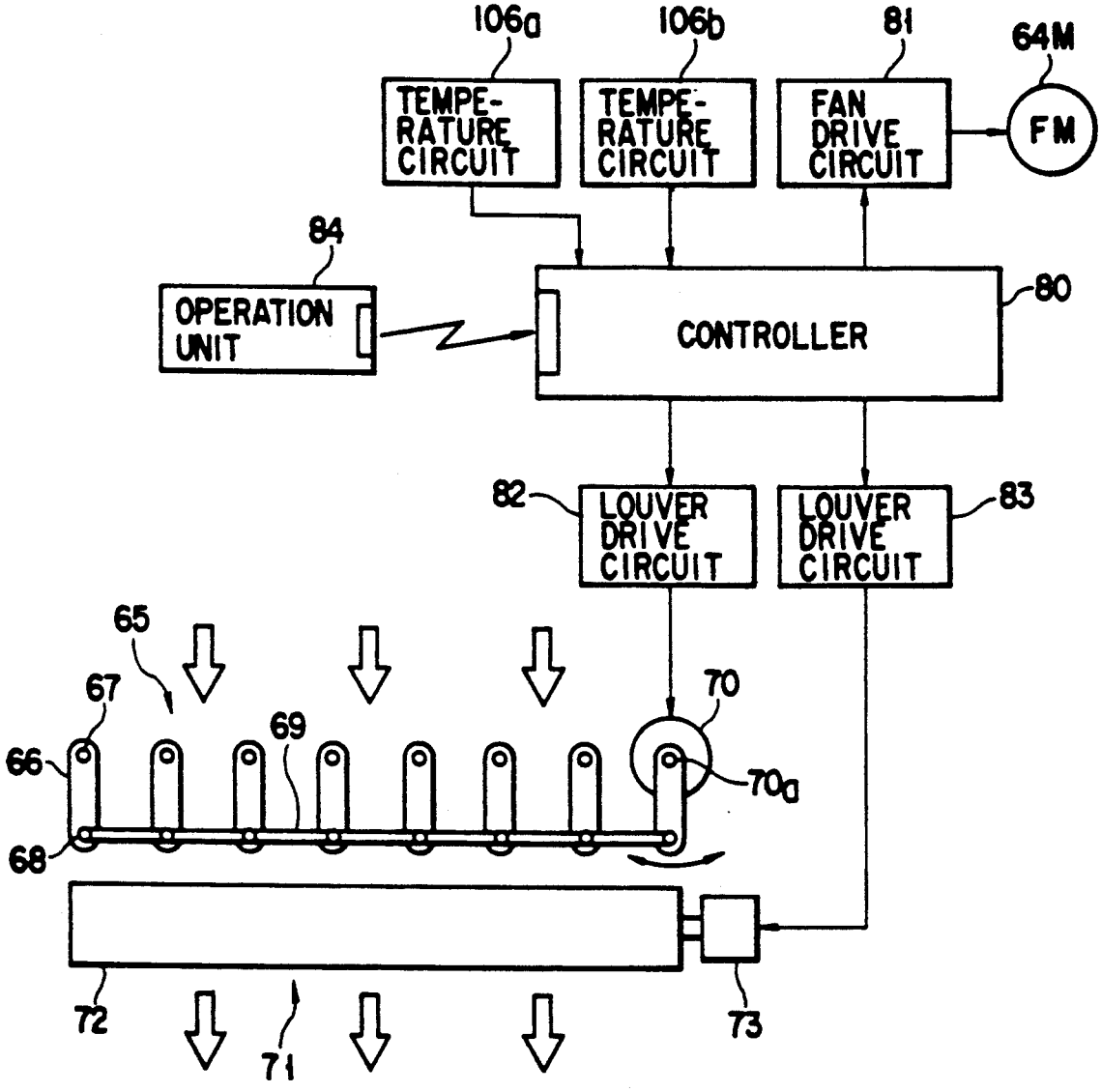
FIG. 21 is a block diagram showing the structure of the louvers and control circuit in the second embodiment.

FIG. 21 shows the control circuit 21.

The controller 80 is connected to the temperature sensors 106*a* and 106*b*, fan drive circuit 81, and louver drive circuits 82 and 83.

The fan drive circuit 81 drives the indoor fan motor 64M at a speed determined by a command from the controller 80.

The louver drive circuit 82 drives the motor 70 of the louver 65 in accordance with a command from the controller 80.

The louver drive circuit 83 drives the motor 73 of the louver 71 in accordance with a command from the controller 80.

A remote-control type operation unit 84 transmits infrared representing various drive condition data to the controller 80.

The controller 80 comprises the following function means:

[1] means for setting the air-blowing direction of the louver 71 in response to data from the operation unit 84;

[2] means for swinging the louver 65 in the horizontal direction;

[3] first detection means for successively outputting a difference between the sensed temperature $T_{r1}(0)$ at the time of start of driving of the temperature sensor 106a and the sensed temperature $T_{r1}(t)$ after the driving (i.e. the first detection means for detecting a variation of the sensed temperature $T_{r1}$ of the temperature sensor 106a from the start of driving);

[4] second detection means for successively outputting a difference between the sensed temperature $T_{r2}(0)$ at the time of start of driving of the temperature sensor 106b and the sensed temperature $T_{r2}(t)$ after the driving (i.e. the second detection means for detecting a variation of the sensed temperature $T_{r2}$ of the temperature sensor 106b from the start of driving);

[5] first difference detection means for detecting a difference, $T_w\{=T_{r1}(0)-T_{r1}(t)-[T_{r2}(0)-T_{r2}(t)]\}$, between the detection result of the first detection means and the detection result of the second detection means;

[6] second difference detection means for detecting a difference, Tn $[=T_{r1}(t)-T_{r2}(t)]$, between the sensed temperature $T_{r1}(t)$ of the temperature sensor 106a and the sensed temperature $T_{r2}(t)$ of the temperature sensor 106b when the detection result (temperature variation difference) $T_w$ of the first difference detection means is a first set value, e.g. 3° C. or more; and

[7] control means for shifting the center of swing of the louver 65 so as to decrease the detection result (temperature difference) Tn of the second difference detection means, only when the absolute value of the detection result Tn is a second set value, e.g. 3° C. or more.

Figure 23:
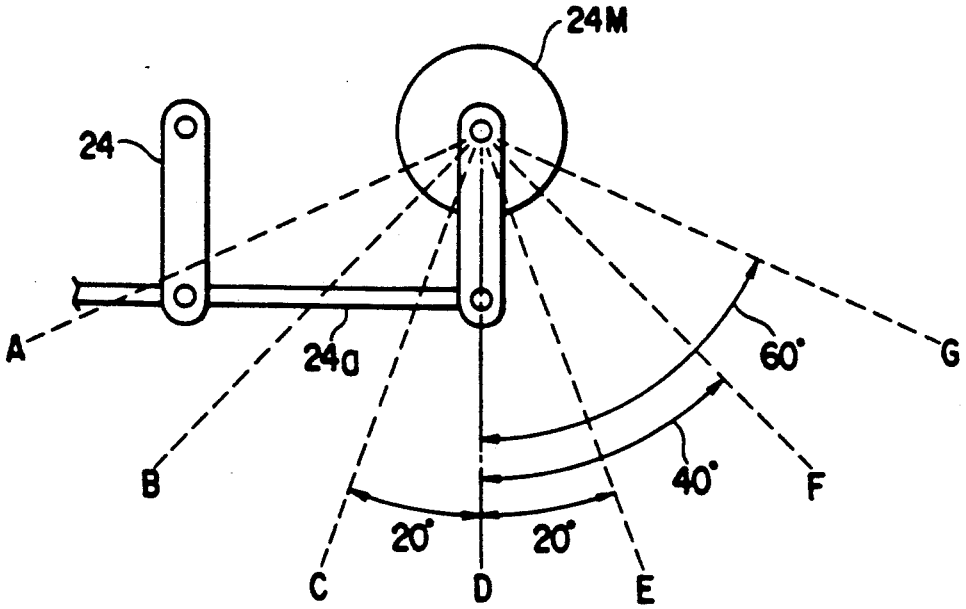
FIG. 23 shows the center of swing of the louver and set angular positions of the louver in the first embodiment.
Figure 22:
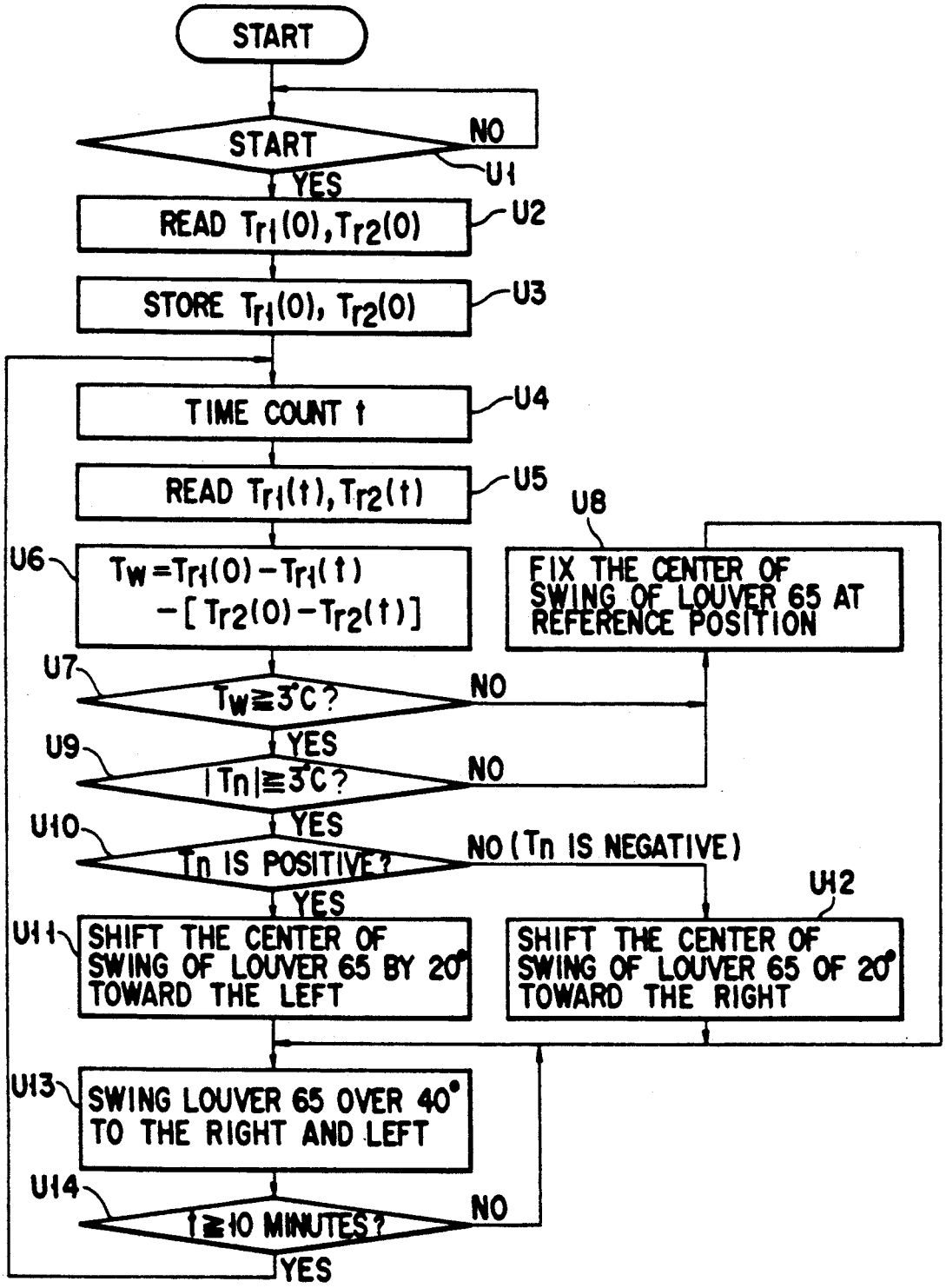
FIG. 22 is a flow chart for illustrating the operation of the second embodiment.

How the direction of blown air is controlled on the basis of the sensed temperatures of the temperature sensors 106a and 106b will now be described with reference to FIGS. 22 and 23.

When the heating operation is started "YES" in step U1), the sensed temperature $T_{r1}(0)$ of the temperature sensor 106a and sensed temperature $T_{r2}(0)$ of the temperature sensor 106b are read (step U2) and the read temperatures are stored in the internal memory of the controller 80 (step U3).

Simultaneously with the start of the heating operation, the time count t is started by the controller 80 (step U4). At every time interval determined by the time count t, the sensed temperature $T_{r1}(t)$ of the temperature sensor 106a and the sensed temperature $T_{r2}(t)$ of the temperature sensor 106b are read (step U5).

The difference between the stored sensed temperature $T_{r1}(0)$ and temperature $T_{r1}(t)$, i.e. the temperature variation of the right-hand area of the indoor unit 1, is successively calculated.

The difference between the stored sensed temperature $T_{r2}(0)$ and temperature $T_{r2}(t)$, i.e. the temperature variation of the left-hand area of the indoor unit 1, is successively calculated.

The difference, $T_w\{=T_{r1}(0)-T_{r1}(t)-[T_{r2}(0)-T_{r2}(t)]\}$, between the calculated detected temperature change of the temperature sensor 106a and the calculated detected temperature change of the temperature sensor 106b is calculated (step U6).

It is determined whether the calculated temperature variation difference $T_w$ is the first set value or 3° or more (step U7).

If the temperature variation difference $T_w$ is less than 3° ("NO" in step U7), the center of swing of the louver 65 is set at the reference position D (step U8). In this state, the louver 65 is swung over 40° to the right and left (step U13). Specifically, the louver 65 is swung between reference position B and reference position F. Before the time count t does not reach the set time of 10 minutes, the swing is continued (step U14).

When the temperature variation is small, for example, at the time of start of operation, the louver 65 is set at the neutral reference position D for 10 minutes.

When the temperature variation difference $T_w$ increases to 3° C. or more ("YES" in step U7), the difference, Tn $[=T_{r1}(t)-T_{r2}(t)]$, between the sensed temperature $T_{r1}(t)$ of the temperature sensor 106a and the sensed temperature $T_{r2}(t)$ of the temperature sensor 106b is calculated, and it is determined whether the absolute value of the temperature difference Tn is 3° C. or more (step U9).

If the absolute value of the temperature difference Tn is less than 3° C. ("NO" in step U9), the swing of the louver 65 is continued while the center of swing is set at the reference position D (step U8 and step U13).

When the absolute value of the temperature difference Tn is 3° C. or more ("YES" in step U9), it is determined whether the temperature difference Tn is positive or negative (step U10).

If the temperature difference Tn is positive $(T_{r1}(t)>T_{r2}(t))$, the center of swing of the louver 65 is shifted by 20° to the reference position C in such a direction that the temperature difference Tn decreases, i.e. toward the low-temperature detection area of the temperature sensor 106b (toward the left of the indoor unit 1) (step U11). In this state, the louver 65 is swung over 40° to the right and left, i.e. between reference position A and reference position E (step U13).

If the temperature difference Tn is negative $(T_{r1}(t)<T_{r2}(t))$, the center of swing of the louver 65 is shifted by 20° to the reference position E in such a direction that the temperature difference Tn decreases, i.e. toward the low-temperature detection area of the temperature sensor 106a (toward the right of the indoor unit 1) (step U11). In this state, the louver 65 is swung over 40° to the right and left, i.e. between reference position B and reference position F (step U13).

In the cooling mode, the center of swing of the louver 65 is shifted to the high-temperature side in such a direction that the temperature difference Tn decreases.

As has been described above, the louver 65 is swung horizontally and the temperature variations in the right and left areas of the indoor unit 1 are successively monitored. The direction of air of the louver 65 is changed to decrease the temperature difference only when the temperature difference in the right and left areas is 3° or more. Thus, the temperature of the entire room can be made uniform quickly and surely.

In the above embodiments, two temperature sensors are provided in one indoor unit in order to sense the temperatures at plural locations. However, for example,, two or more temperature sensors may be attached at different locations on the floor of the room, and such sensors may be used.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air conditioning apparatus having a louver for changing the direction of air into a room, comprising:

temperature sensing means for sensing temperatures at a plurality of locations in the room;

difference detection means for detecting a difference between sensed temperatures of the temperature sensing means;

swing means for swinging the louver;

control means for setting the center of swing of the louver at a position corresponding to the detection result of the difference detection means; and control means for changing the angle of swing of the louver in accordance with the detection result of the difference detection means.

2. The apparatus according to claim 1, wherein said louver changes the direction of air in a horizontal direction in the room.

3. The apparatus according to claim 1, wherein the temperature sensing means-senses radiation heat temperatures at two locations, i.e. a right-hand location and a left-hand location in the room.

4. An air conditioning apparatus having a louver for changing the direction of air into a room, comprising:

first and second temperature sensors for sensing temperatures at a plurality of locations in the room;

first detection means for detecting a variation in the sensed temperature of the first temperature sensor from the start of operation of the apparatus;

second detection means for detecting a variation in the sensed temperature of the second temperature sensor from the start of operation of the apparatus;

first difference detection means for detecting a difference between the detection result of the first detection means and the detection result of the second detection means;

second difference detection means for detecting a difference between the sensed temperature of the first temperature sensor and the sensed temperature of the second temperature sensor when the detection result of the first difference detection means is a first set value or above;

swing means for swinging the louver; and control means for shifting the center of swing of the louver in such a direction that the detection result of the second difference detection means decreases, only when the detection result of the second difference detection means is a second set value or above.

5. The apparatus according to claim 4, wherein said louver changes the direction of air in a horizontal direction in the room.

6. The apparatus according to claim 4, wherein the first and second temperature sensors sense radiation heat temperatures at two locations, i.e. a right-hand location and a left-hand location in the room.

* * * * *